United States Patent [19]

DuShane et al.

[11] 4,166,299

[45] Sep. 4, 1979

[54] EXTENDABLE BED MECHANISM

[75] Inventors: Ray N. DuShane, Fullerton; Carl H. Schulman, Encino, both of Calif.

[73] Assignee: J.B.R. Furniture Concepts, Encino, Calif.

[21] Appl. No.: 884,985

[22] Filed: Mar. 9, 1978

[51] Int. Cl.[2] ..... A47C 17/10

[52] U.S. Cl. ..... 5/18 R

[58] Field of Search ..... 5/12, 13, 17, 18, 27, 5/29; 312/341 R, 348

[56] References Cited

U.S. PATENT DOCUMENTS

| | | | |
|---|---|---|---|
| 479,071 | 7/1892 | Holstein | 5/18 R |
| 1,346,582 | 7/1920 | Zwolinski | 5/13 |
| 2,932,541 | 4/1960 | Gulbrandsen | 5/12 R |
| 3,041,635 | 7/1962 | Holtzclaw | 5/18 R |
| 3,710,403 | 1/1973 | Weldner et al. | 5/18 R |
| 3,782,800 | 1/1974 | Remington et al. | 312/348 |
| 3,972,079 | 8/1976 | Shellow | 5/18 R |
| 3,974,529 | 9/1976 | Johnson et al. | 5/18 R |
| 3,974,529 | 8/1976 | Johnson et al. | 5/18 R |
| 3,995,927 | 12/1976 | Stein | 312/341 R |
| 4,016,611 | 4/1977 | Harty | 5/13 |

FOREIGN PATENT DOCUMENTS

| | | | |
|---|---|---|---|
| 726759 | 12/1966 | Italy | 5/18 R |

*Primary Examiner*—Casmir A. Nunberg

*Attorney, Agent, or Firm*—Romney, Schaap, Golant, Disner & Ashen

[57] ABSTRACT

An extendable bed mechanism connected to a sofa bed to allow conversion between a sofa and a bed in an easy, facilitated manner. The mechanism is relatively inexpensive and light weight and comprises a movable panel, two pairs of brackets and two sets of wheels or rollers for supporting the panel, preventing wobble and allowing minimum physical effort. A simple locking handle is also provided for restraining the panel in an extended or a retracted position. It is contemplated that Voraspring brand expanded polymer will be used for the cushions-mattress; in combination this assures a superior sleeping surface.

4 Claims, 9 Drawing Figures

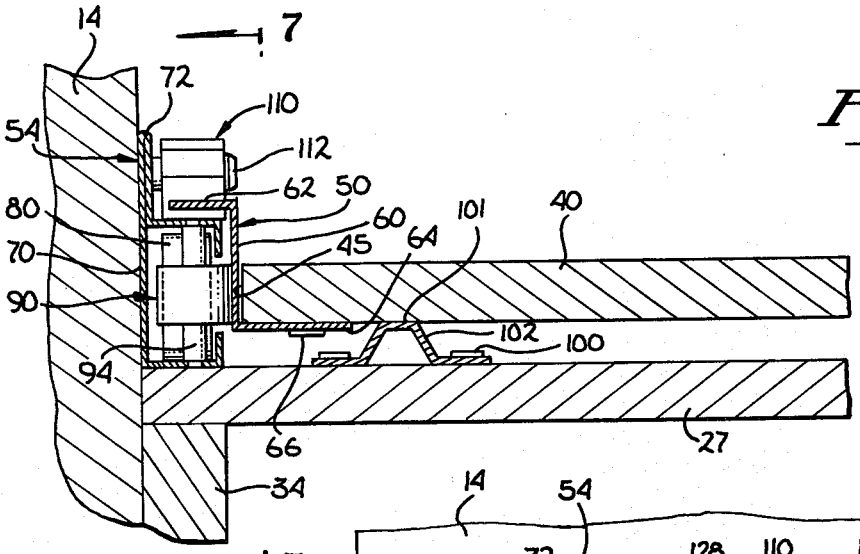
Fig. 6
Fig. 7
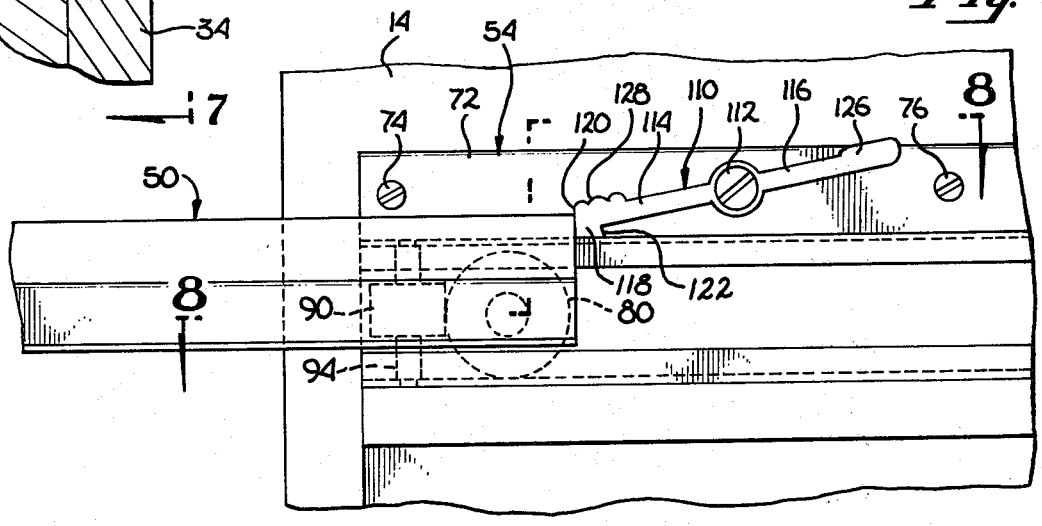
Fig. 8
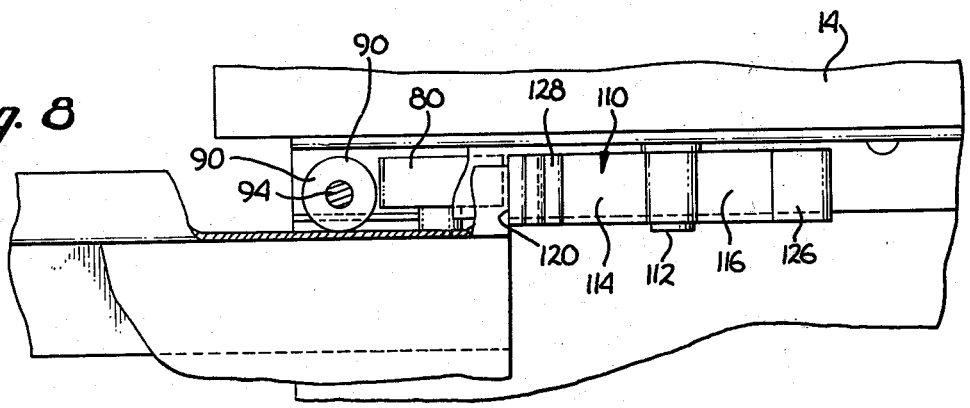
Fig. 9
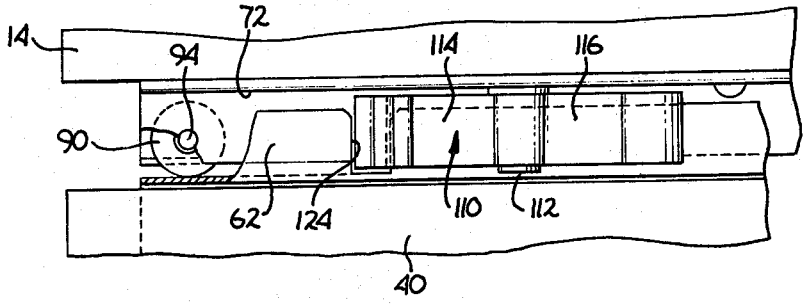

EXTENDABLE BED MECHANISM

BACKGROUND OF THE INVENTION

1. Field of the Invention

The present invention relates to an extendable bed mechanism and, more particularly, to a mechanism which may be attached to a sofa or other article of furniture or mounting frame for extending to form a base upon which a mattress material may be placed. The mechanism is light weight, inexpensive, very easy to use and forms a superior bed support.

2. Desription of the Prior Art

Sofa beds and their related linkages have been known for many years and a number of United States patents relating to pull-out beds exist. By way of example, U.S. Pat. No. 1,346,582 was issued to Zwolinski in 1920 for an extendable chair bed, while in 1976, U.S. Pat. No. 3,974,529 was issued to Johnson et al for a bed and lounge unit. There are presently a number of different sofa bed products on the market using various mechanisms for the purpose of converting a seating device to a sleeping device. However, these various items all suffer from one or more of the following disadvantages: they are overly complicated, too heavy, difficult to use, too expensive and depressingly uncomfortable. That many problems exist is best exemplified by the continuing issuances of patents in the field; the problems mentioned above have been long standing and have engendered continuing attention.

SUMMARY OF THE INVENTION

The present invention greatly alleviates or eliminates the problems existing in the prior art by providing an extendable bed mechanism connected to a mounting frame comprising means for mounting a mattress connected to the frame and moveable between extended and retracted positions; first bracket means connected to the mattress supporting means; second bracket means connected to the supporting frame; a first set of guide wheels connected to the mattress supporting means for engaging the second bracket means and guiding the mattress supporting means; and a second set of guide wheels connected to the second bracket means for engaging the first bracket means and guiding the mattress supporting means.

An aim of the present invention is to provide an extendable bed mechanism, for example, as part of a sofa bed which is simply constructed, light weight and relatively inexpensive. Another aspect of the present invention is to provide an extendable bed mechanism which is reliable and easy to use, even by women and children. Still another object of the present invention is to provide an extendable bed mechanism which in combination with a suitable mattress material such as that sold under the Voraspring brand provides a superior sleeping surface.

The foregoing objects, advantages, features and results of the present invention together with various other objects, advantages, features and results thereof which will be evident to those skilled in the art in the light of this disclosure may be achieved with the examplary embodiment of the invention described in detail hereinafter and illustrated in the accompanying drawings.

BRIEF DESCRIPTION OF THE DRAWINGS

FIG. 6 is an enlarged elevational sectional view taken within the region defined by the curved line 6—6 of FIG. 5.

FIG. 7 is an elevational view taken along line 7—7 of FIG. 6.

FIG. 8 is a partially broken away view taken along line 8—8 of FIG. 7, the sofa bed being illustrated in its extended position.

FIG. 9 is a partially broken away plan view similar to that shown in FIG. 8 with the sofa bed in a retracted position and a locking handle acting to restrain the sofa bed in its retracted position.

DESCRIPTION OF THE PREFERRED EMBODIMENT

Figure 1:
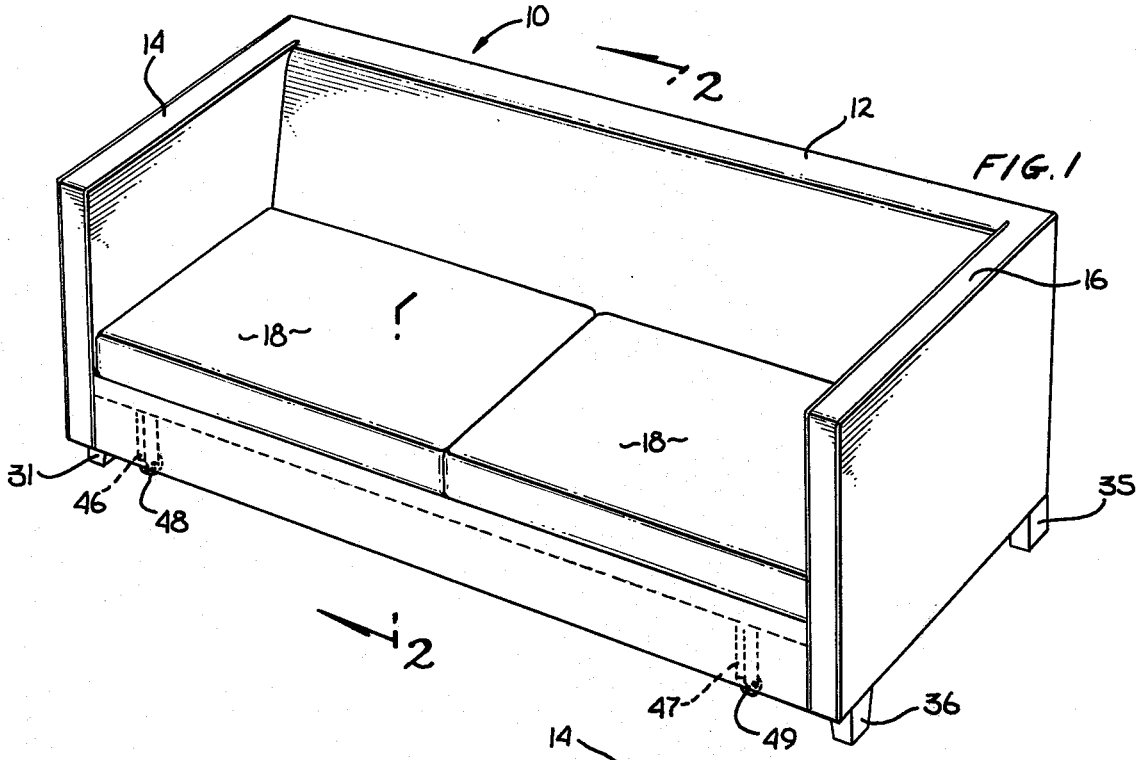
FIG. 1 is a isometric view of a sofa bed illustrated in its retracted or sofa position.

While the present invention is susceptible of various modifications and alternative constructions, an illustrative embodiment is shown in the drawings and will herein be described in detail. It should be understood, however, that it is not the intention to limit the invention to the particular form disclosed; but on the contrary, the invention is to cover all modifications, equivalences and alternative constructions falling within the spirit and scope of the invention as expressed in the appended claims.

Figure 2:
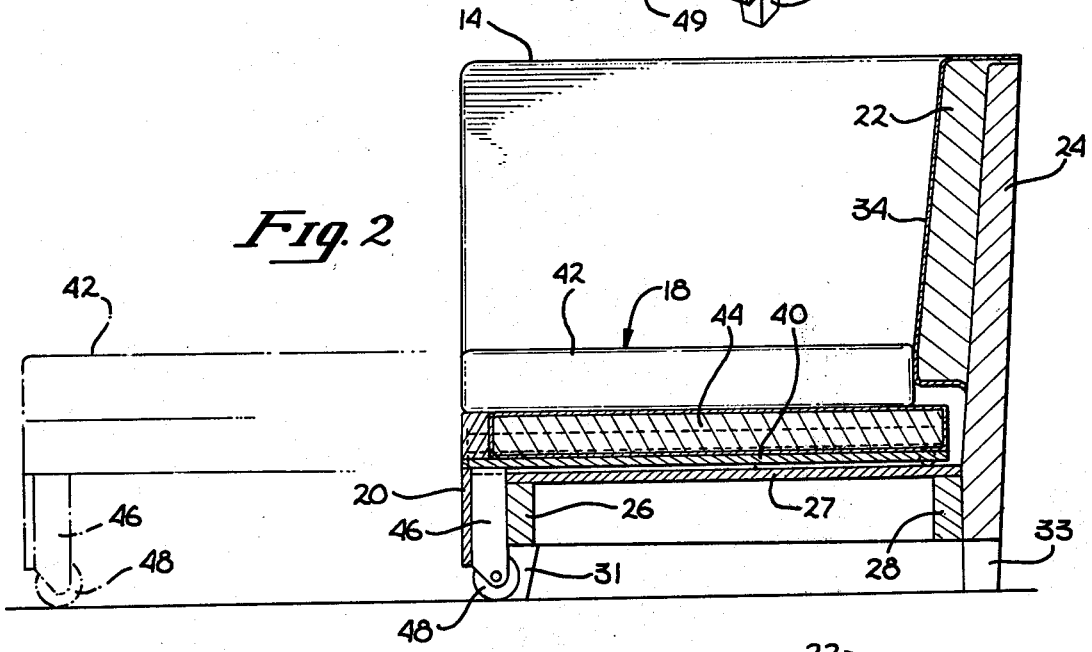
FIG. 2 is an elevational sectional view of the sofa bed shown in FIG. 1 taken along line 2—2; the sofa bed in an extended position is partially illustrated in phantom lines.
Figure 5:
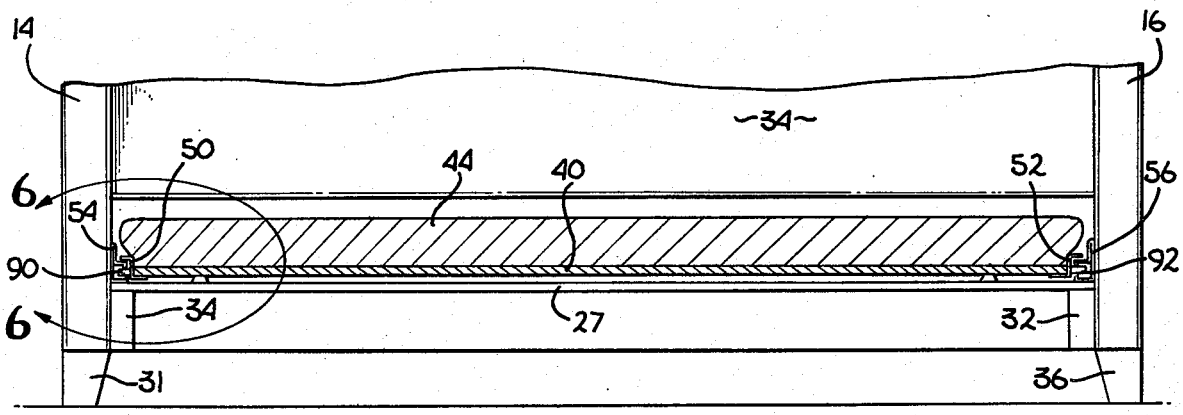
FIG. 5 is a partial elevational sectional view taken along line 5—5 of FIG. 4.

Referring now to FIG. 1, there is illustrated a sofa bed 10, a part of which is an extendable bed mechanism to be described below. The sofa bed includes a back portion 12, left 14 and right 16 arm portions, a seat 18 and a facia 20. As shown in FIG. 2, the back portion 12 of the sofa bed includes a back cushion 22 and a back support 24. Also included are two longitudinal box members 26 and 28 and two lateral box members 30 and 32 which are illustrated in FIG. 5. In the usual manner, upholstery 34 covers the cushions, arms, back and facia in a usual manner. The sofa bed is supported by four legs, 31, 33, 35 and 36, FIGS. 1 and 2. The back support 24, arms 14, 16 and box members 26, 28, 30 and 32 form a mounting frame for the mechanism to be described. It is to be understood that a large number of different structures can be used to form a mounting frame though a sofa bed is a traditional one.

Figure 3:
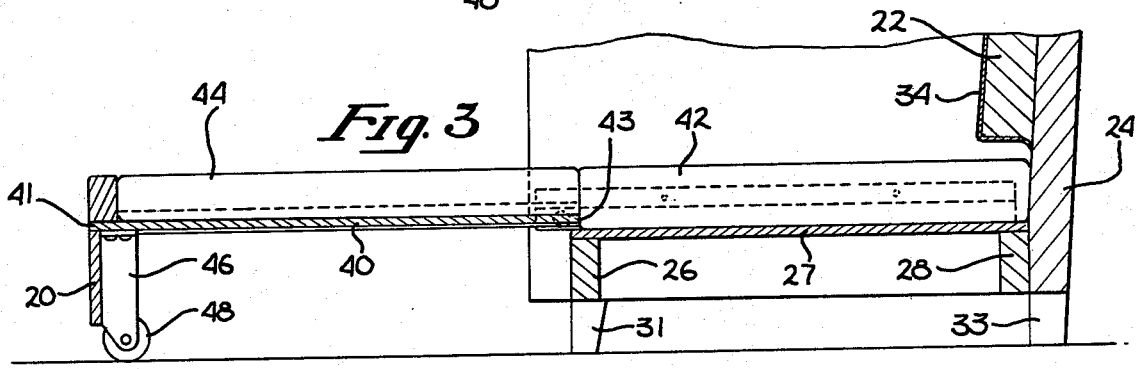
FIG. 3 is a partial elevational sectional view like that shown in FIG. 2 except that the sofa bed is in its extended position with seat cushions in place as a mattress.
Figure 4:
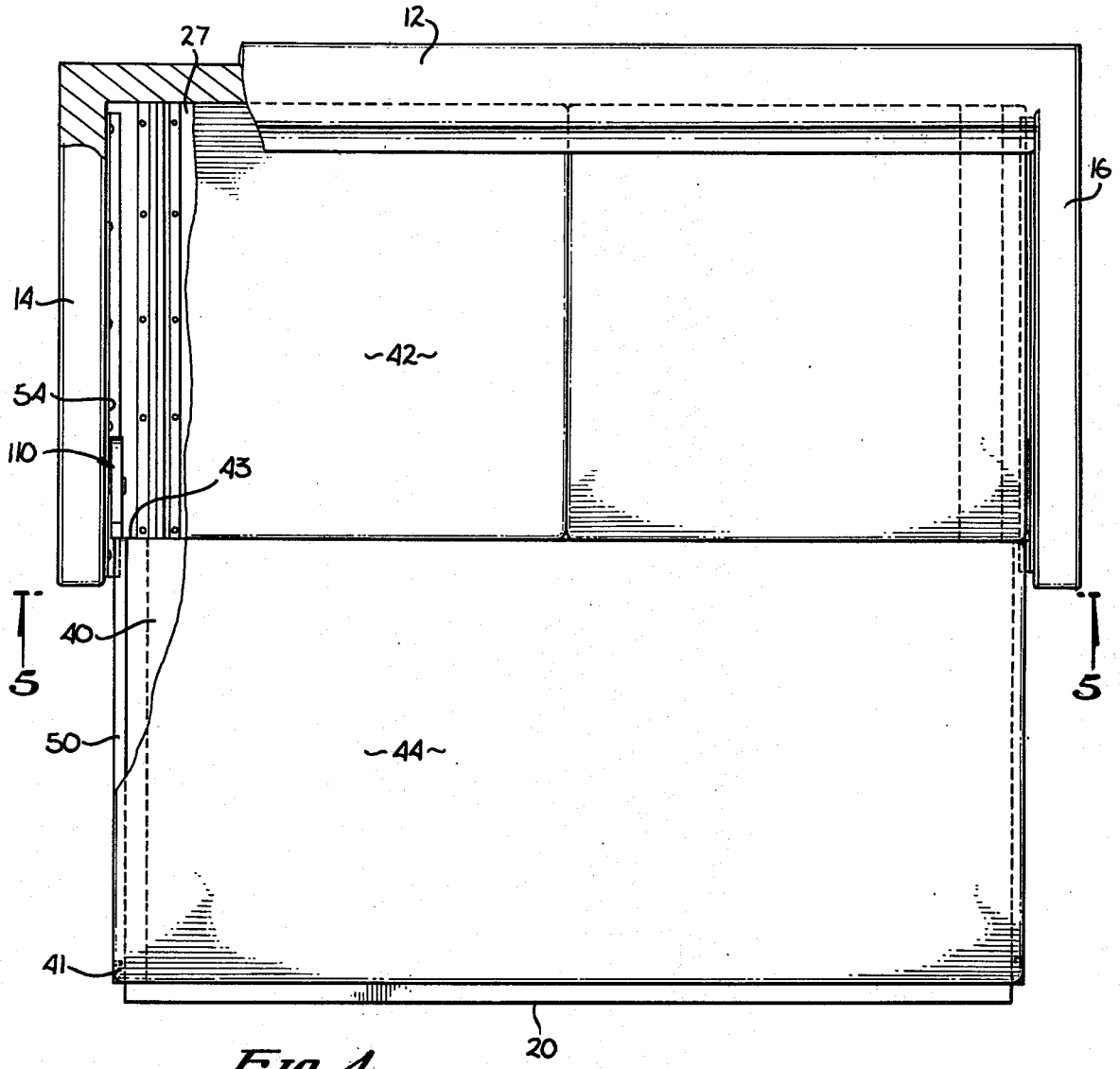
FIG. 4 is a partially broken away plan view of the sofa bed in its extended position as shown in FIG. 3.

Supported by the box members is a seat deck or stationary panel 27. Supported on the stationary panel is mattress mounting means in the form of a panel 40 having front 41 and rear 43 portions which is moveable between an extended position as shown in FIG. 3 and a retracted position as shown in FIG. 2. When in the retracted position the seat 18 is comprised of an upper cushion 42 and a lower cushion 44 in a folded condition. When in an extended position, the cushions are unfolded to become a mattress surface. Supporting the extended end of the moveable panel 40 are two brackets 46, 47 to which are mounted two rollers 48, 49.

Illustrating the simple and inexpensive construction of the extendable bed mechanism, reference is made to FIGS. 2, 3, 4 and 5. Attached to the movable panel is a pair of brackets 50, 52 while attached to the arms and lateral box members are a pair of fixed brackets 54, 56. Mounted to each pair of brackets are wheels to be described below in more detail.

It is contemplated that the seat 18 which also forms the mattress to be used with the bed mechanism is constructed of urethane foam containing expandable beads. For example, the Dow Chemical Co. of Midland, Michigan offers such a product under the trademark VORASPRING, the product being generically called a support polymer. Not only does this material facilitate the handling needed to change the sofa into a bed, but VORASPRING support polymer provides a superior sleeping surface when the sofa bed is in the position shown in FIG. 3.

Illustrating the advantages of light weight, simple construction and ease of use, attention is directed to FIGS. 6, 7, 8 and 9. For the sake of brevity, only one bracket of each pair will be described in detail, it being understood that the other bracket of the pair contains identical parts or sections except in a reversal of orientation. Referring to FIG. 6, the bracket 50 includes a middle vertical section 60, a upper extending arm 62 and a lower oppositely extending arm 64. The panel 40 rests upon the lower arm 64 and may be connected to the bracket 60 by a fastener 66 such as a screw. It is noted that the bracket is one integral piece having a double bend, one bend where the upper arm 62 intersects the middle section 60 and the other where the lower arm 64 intersects the middle section. This double bend arrangement provides for a relatively stiff yet light weight bracket. It is anticipated that the bracket 50 will be approximately twenty-nine inches long, the lower arm 64 will be approximately one inch long, the upper arm 62 will be a half inch long, and the middle section 60 will be one inch long.

The second pair of brackets, such as represented by bracket 54, includes two sections, a channel shaped section 70 and an upstanding arm section 72. Once again, as clearly shown in FIG. 6 the bracket may be made of one integral piece bent to the desired shape. As shown in FIG. 7, the bracket 54 abuts and is connected to the arm 14 with fasteners such as screws 74, 76 and is also supported by the stationary panel 27. The various bends in the brackets provide added stiffness while the arm portion 72 allows the bracket to be attached to the sofa bed in a facilitated manner during assembly of the sofa bed. The bracket 54 is also about twenty-nine inches long, the upstanding arm is about three quarters of an inch long, the width of the channel is about five-eighths of an inch and the height of the channel is about one and a quarter inches.

Attached to the rear portion 43 of the movable panel is a set of guide wheels of which one guide wheel 80 is clearly shown in FIGS. 6, 7 and 8 (the other wheel is identical). With the rollers 48, 49 the guide wheels are able to support the movable panel 40 and allow its easy reciprocal movement between its extended and retracted positions.

Mounted to the bracket 54 near the forward portion of the sofa is a second set of guide wheels or rollers 90, 92. As shown in more detail in FIGS. 6 and 8, the roller 90 is mounted to a shaft 94 which in turn is attached to the channel section 70 of the bracket 54 in a manner to allow engagement with the middle vertical section 60 of the bracket 50 (the other roller 92 is identically placed on the bracket 56). It can be appreciated that in this manner lateral wobble of the movable panel 40 is closely controlled. Guidance and wobble control is also achieved by the placement of the roller 80 within the channel section 70 of the bracket 54.

It can be appreciated that both the brackets 50 and 54 may be formed into the desired shape on a continuous basis and cut to the desired length. All of this enhances the low cost nature of the mechanism.

Connected to the stationary panel 27 by suitable fasteners such as a screw 100, FIG. 6 is a support means in the form of a runner 102 having an upwardly projected portion 104 upon which the movable panel 40 may rest so as to prevent sagging. Once again, the support runner 102 may be made of rolled material or of a synthetic resin which may be extruded. It is contemplated that the space between the panels 27 and 40 is about three-eighths of an inch while the panels themselves may be made of one-half inch plywood. It is however to be understood that other materials may be used for various parts of the mechanism. By way of example, the movable panel 40 and the bracket 50 may be constructed of a one piece synthetic resin. By the same token, the seat panel 27 and the bracket 54 may be integrally formed of a synthetic resin material or the arm 14 and the bracket 54 may be so constructed.

Referring to FIGS. 7, 8 and 9, a locking means in the form of a pivotal handle 110 is connected to the bracket 54 and the arm 14 by a screw 112 about which the handle 110 can pivot. The handle includes two oppositely extending arms 114 and 116. At the extended end of the first arm 114 is a head 118 having an outer surface 120 and an inner surface 122. As shown in FIG. 9, the upper arm 62 of the bracket 50 includes a recess 124 for receiving a portion of the head 118 of the locking handle 110. When the movable panel is in its retracted position, FIG. 9, there can be engagement of the inner surface 122 and the upper arm 62 of the bracket 50 by pushing downward on a pad 128. This will prevent the movable panel from inadvertently being extended. As shown, the outer and inner surfaces of the head are slanted so that if the movable panel is attempted to be extended, the forces acting upon the locking handle will enhance engagement between the handle and the bracket to more securely restrain the movable panel. Release of the locking handle is accomplished by merely applying pressure to a pad 126 at the end of the arm 116 to cause the handle to pivot. When the movable panel is in its extended position, the locking handle may be again used to restrain movement. Locking is accomplished by having the outer surface 120 abut the end 130 of the bracket 50, as shown in FIG. 7.

The extendable bed mechanism operates in a very simple manner, especially when it is part of a sofa bed as illustrated and described. In operation, from a retracted position as shown in FIG. 1, it is only necessary to press downwardly on the pad 126 of the locking handle 110 to disengage the movable panel. Thereafter, a slight tug on the facia 20 will cause the movable panel to slide outwardly to its extended position. As shown in phantom line in FIG. 2, the seat cushions 42 and 44 ride out with the movable panel to its extended position shown in FIG. 3. The locking handle locks the moveable panel and the operator merely has to flip or unfold the cushion 42 through an arc of 180° to its position shown in FIG. 3 where it rests upon the stationary panel 27. With the addition of appropriate linen, the sofa bed is ready for use as a sleeping surface. If the cushions 42 and 44 are constructed of Voraspring brand support polymer, a very superior sleeping surface is provided. To return the bed to its retracted position so that it may be used as a sofa, the cushion 42 is pivoted through 180° to rest upon the cushion 44. Thereafter, the locking handle is pivoted out of abuttment and the facia is given a push to cause the movable panel to slide to its retracted position. Once again, the locking handle may be returned to a locking position as shown in FIG. 9.

What has been described is an easily operated, simply constructed, inexpensive mechanism which is very light in weight and reliable. When combined with a support polymer, an extremely comfortable sofa and bed is provided.

It is to be understood that the mechanism can be used with many different types of furniture, such as a regular bed, a hidden wall unit or the like and that the material used may be a function of quantity and production costs.

What is claimed is:

1. An extendable bed mechanism connected to a mounting frame, such as a sofa frame comprising:

a mounting frame;

a first generally flat panel having front and rear portions and side edges, said panel for supporting a mattress or other sleeping surface and being moveable between extended and retracted positions;

a second generally flat panel fixed to said mounting frame;

means connected to said second panel for supporting said first panel and spacing it relative to said second panel;

two rolling support elements connected to the front portion of said first panel for supporting said first panel;

a first bracket pair attached to the side edges of said first panel for supporting and guiding said first panel during movement;

a first pair of rollers rotatably attached to said first panel, one along each side edge at said rear portion, said rollers being rotatable in a plane perpendicular to the plane of said first panel;

a second bracket pair attached to said frame, each of said second bracket pair having a generally C-shaped cross-section for receiving one of said rollers;

a second pair of rollers rotatably connected to said second bracket, said rollers being rotatable in a plane parallel to the plane of said first panel for bearing against said first bracket pair;

a locking handle pivotally attached to said frame, said handle having two operating pads at each disposed at opposite sides of the pivot, said handle being engageable with one of said first bracket pair at two different portions thereof to restrain said first panel in an extended or a retracted position.

2. A mechanism as claimed in claim 1 where each element of said second bracket pair includes an upstanding arm section extending along its length for allowing said bracket to be fixed to said frame and for supporting said locking handle.

3. A mechanism as claimed in claim 1 wherein said first panel supporting and spacing means is an elongated runner having an upper flat surface for making sliding engagement with said first panel.

4. A mechanism as claimed in claim 1 including a foldable cushion having unequal height sections, the shorter of which rests upon said first panel and the taller of which rests upon said second panel when said first panel is in its extended position, said cushion being folded with said taller section on top of said shorter section when said first panel is in a retracted position.

* * * * *